United States Patent [19]

Silberman

[11] 4,382,596

[45] May 10, 1983

[54] WEIGHT LIFTING TYPE EXERCISING DEVICE

[75] Inventor: Ira J. Silberman, Opelika, Ala.

[73] Assignee: Diversified Products Corporation, Opelika, Ala.

[21] Appl. No.: 349,857

[22] Filed: Feb. 18, 1982

Related U.S. Application Data

[62] Division of Ser. No. 12,487, Feb. 15, 1979, Pat. No. 4,316,609.

[51] Int. Cl.[3] ..... A63B 21/06

[52] U.S. Cl. ..... 272/118; 272/134; 272/123; 272/145

[58] Field of Search ..... 272/118, 117, 134, 144, 272/93, DIG. 4, 900, 123

[56] References Cited

U.S. PATENT DOCUMENTS

| | | | |
|---|---|---|---|
| 3,625,511 | 12/1971 | Rennemann | 272/144 |
| 3,640,528 | 2/1972 | Proctor | 272/118 |
| 4,257,590 | 3/1981 | Sullivan et al. | 272/144 |
| 4,286,782 | 9/1981 | Fuhrhop | 272/117 |

OTHER PUBLICATIONS

"Master Gym"—Marcy Institutional Catalogue, 1979.

*Primary Examiner*—Richard C. Pinkham
*Assistant Examiner*—William R. Browne
*Attorney, Agent, or Firm*—Schuyler, Banner, Birch, McKie and Beckett

[57] ABSTRACT

A simple and versatile exercising apparatus is provided which enables the user to perform a wide variety of weight training exercises. The apparatus includes a basic bench with barbell cradle, a rope and pulley weight pull device, a lat bar device with squat rack and chinning bar, and readily attachable devices for performing curling, sit-ups and leg lifts.

4 Claims, 12 Drawing Figures

FIG. 5.
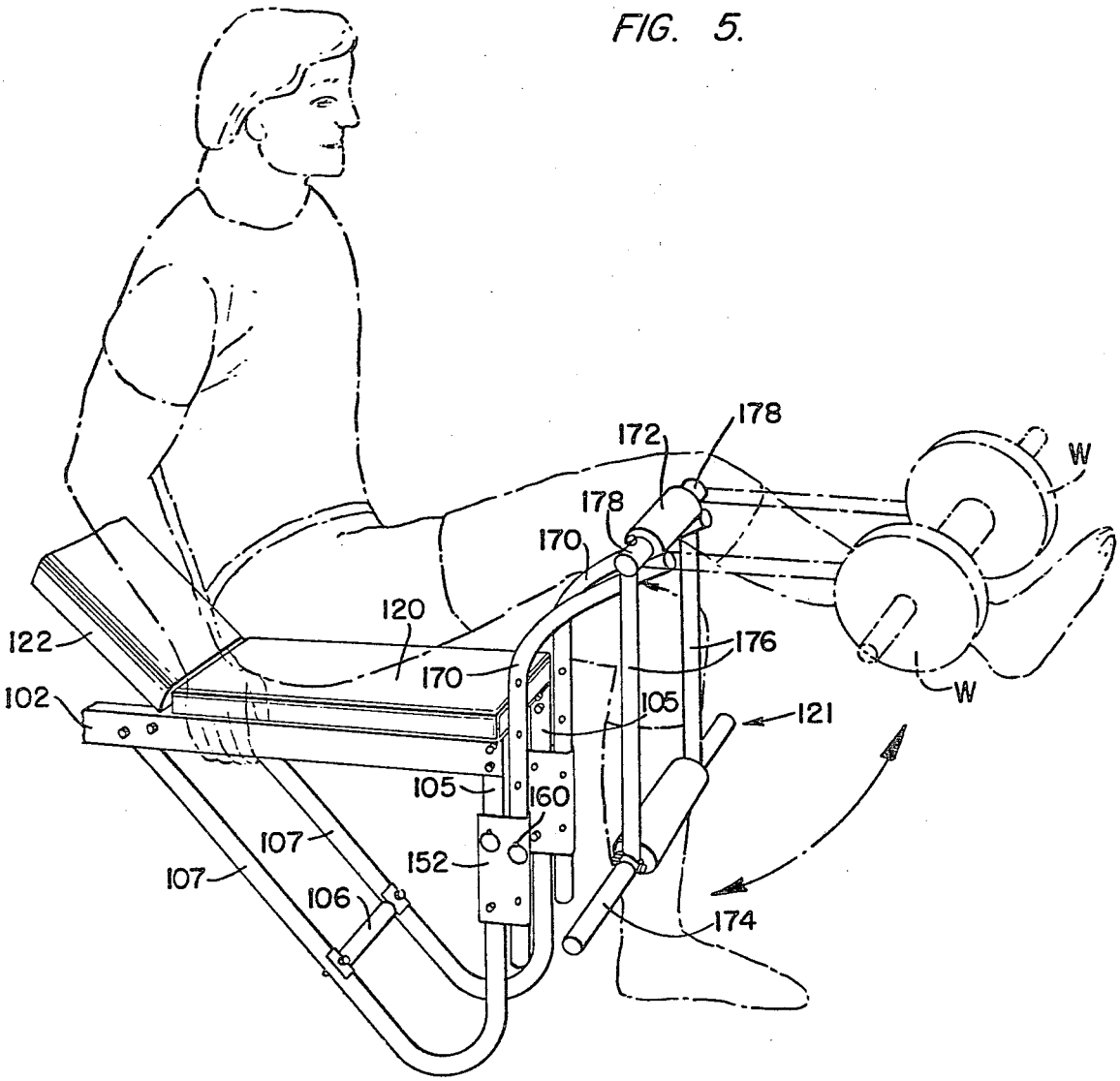
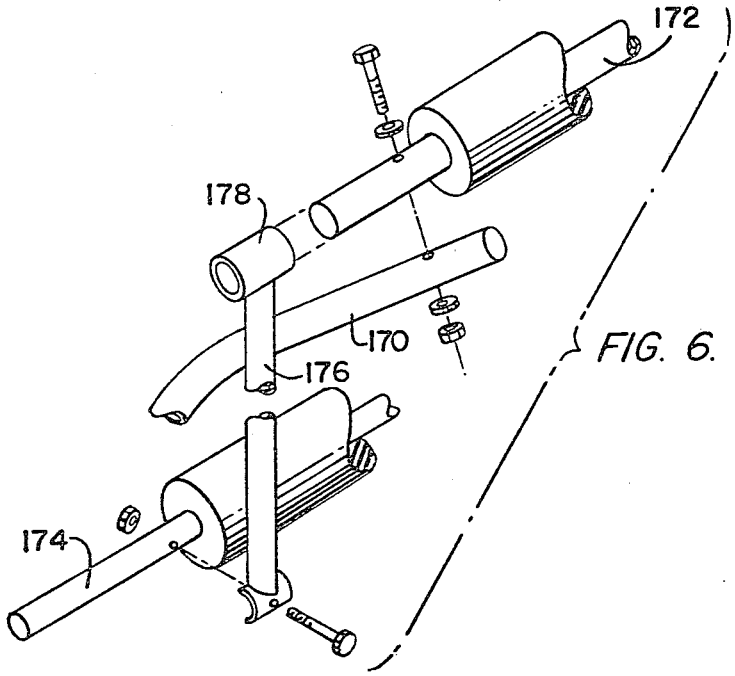
FIG. 6.

WEIGHT LIFTING TYPE EXERCISING DEVICE

This application is a division, of application Ser. No. 12,487, now U.S. Pat. No. 4,316,609, filed Feb. 15, 1979.

BACKGROUND OF THE INVENTION

1. Field of the Invention

The present invention relates to exercising devices for developing and conditioning various parts of the body.

2. Description of the Prior Art

The importance of regular exercise for building and maintaining strength and endurance cannot be overemphasized. The modern conveniences which we enjoy and the sedentary tasks which was increasingly perform have given us a comfortable lifestyle at the expense of physical fitness. Highly active exercise programs, such as running, develop endurance of the cardiovascular system. Muscular strength and endurance is best developed through weight training.

The simplest and least expensive apparatus for weight training is the barbell with removable weights. However, the use of a barbell alone cannot develop all areas of the body. Hence, additional apparatus must be employed for a comprehensive conditioning program. Devices developed for this purpose generally provide the user with a force resistor against which muscular effort must be applied. Resistance is typically provided by means of a weight and pulley arrangement, or an elastic element. These devices permit the force to be applied to the user's body from many different directions in order to develop substantially all areas of the body.

Few of these weight training devices, however, can provide the user with substantially all of the exercising variants required to develop the entire body. Those that do are generally large, complex and costly machines which cannot be used with a common barbell set and consequently are not suitable for home use. These are usually found only at health clubs and other athletic establishments. More specialized devices for developing limited areas of the body are available, but a number of different devices of this type must be used in order to provide a complete range of exercises.

SUMMARY OF THE INVENTION

Accordingly, it is an object of the present invention to obviate the above-noted disadvantages of the prior art by providing a simple and inexpensive exercising apparatus for performing a complete range of weight training exercises.

Another object of the invention is to provide such an apparatus which is self-supporting yet strong, stable and relatively compact.

Another object of the invention is to provide such an apparatus having some components which may be used independently of or interchangeably with others.

Another objects of the invention is to provide such an apparatus which is used in conjunction with a simple and inexpensive barbell set for providing the desired exercises.

Another object of the invention is to provide a single multi-purpose exercise device which can be purchased in modular components at various periods of time rather than requiring the single purchase of a total unit.

Another object of the invention is to provide such an exercise device which is designed to be assembled by the consumer and shipped in separate cartons of manageable size.

Another object of the invention is to provide such an apparatus having adjustable components which may be adjusted to suit the needs of various users.

These and other objects of the present invention are accomplished by providing an exercising apparatus comprising a bench having an elongated bench frame, a fixed seat portion supported on the bench frame at the foot end of the bench, an adjustable incline seat portion hinged adjacent to the fixed portion and extending to the head end of the bench, and means for adjustably supporting the incline portion on the bench frame at a desired angle of inclination; and a weight pull device at the head end of the bench having a pair of upstanding parallel guides attached to the bench frame, a top crosspiece interconnecting the upper ends of the guides, weight supporting means slidably guided along the guides, weight pulley means connected to the top crosspiece and at least one tension element connected to the weight supporting means and trained through the pulley means to be pulled by a user lying or sitting on the bench.

The bench may also be provided with a barbell rest cradle supported at the top of barbell rest tubes attached to the bench frame. This arrangement permits the user to perform bench pressing type exercises while lying on the bench. In addition, the bench frame may be provided at its foot end with means for attaching and supporting other exercise equipment, such as an upper arm-supporting barbell curling board, a leg lift device employing barbell weights, or an inclined slant board sit-up device. A weight pull device incorporating a tension element may be attached to the head end of the bench, and a lat bar device may also be provided adjacent to the weight pull device. The lat bar device will include an overhead pulley for directing the tension element from the weight pull device to a user-pulled lat bar.

In addition to the above combinations of exercise devices, the invention also encompasses an improved exercising bench structure having bent tubular legs and a laterally extending floor frame.

BRIEF DESCRIPTION OF THE DRAWINGS

The novel features of the invention are set out with particularly in the appended claims, but the invention will be understood more fully and clearly from the following detailed description of the invention as set forth in the accompanying drawings, in which:

FIG. 5 is a perspective view of the bench being used in conjunction with the leg lift device;

FIG. 6 is an exploded view showing certain details of the leg lift device;

DESCRIPTION OF THE INVENTION

In the preferred embodiment shown in the figures, most of the structural elements of the invention are tubular steel members which are secured together by bolted connections. Of course, other types of members of various cross-section may be used, and they may be secured together by other means, such as welding.

Figure 1:
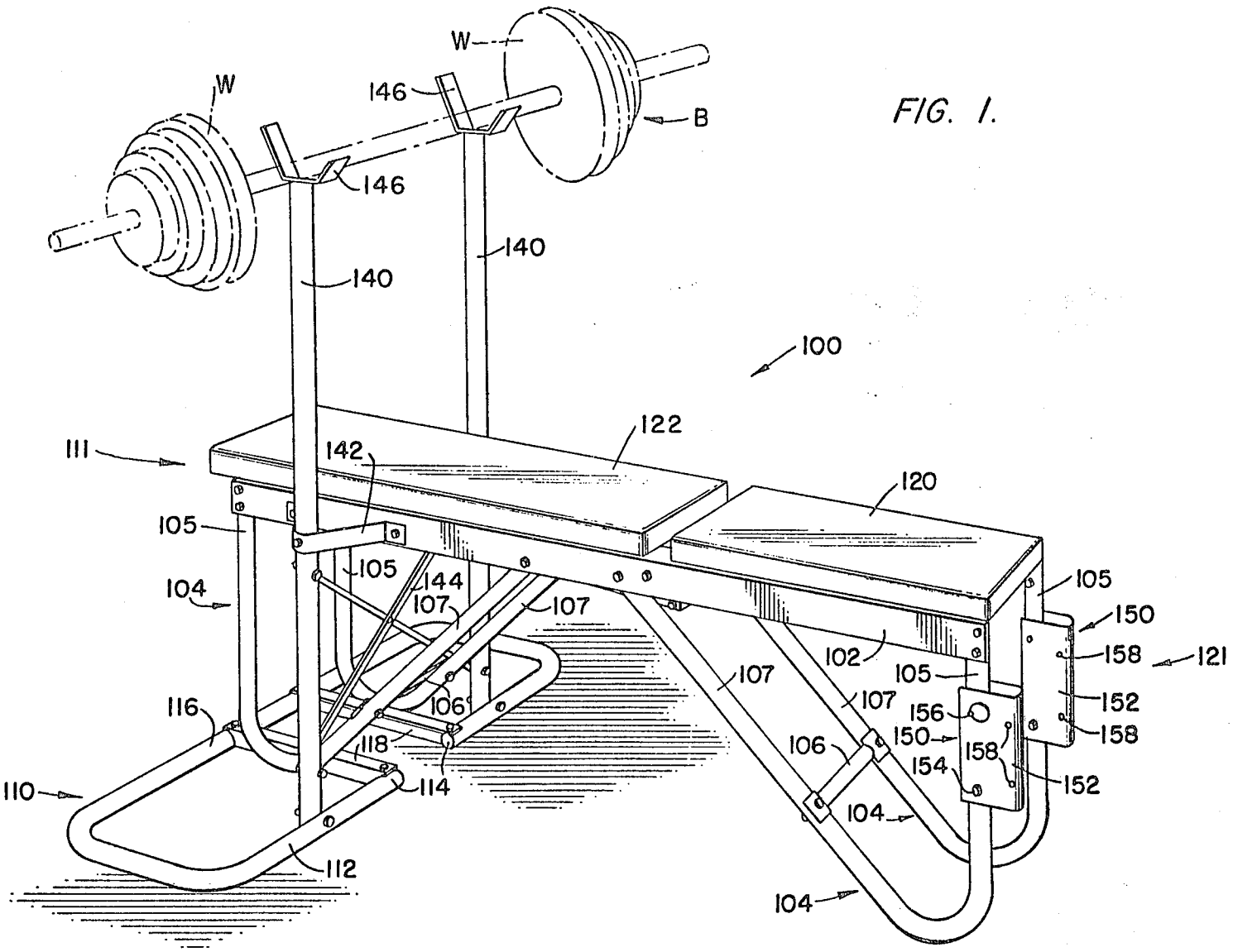
FIG. 1 is a perspective view of the basic exercising bench according to the invention.

Referring particularly to FIG. 1, the apparatus according to the invention includes as its basic element an exercising bench 100 comprising a pair of L-shaped side rails 102 and four bent tubular legs 104 having vertical end portions 105 bolted to the ends of side rails 102 and oblique portions 107 bolted to the intermediate portions of side rails 102. The two legs 104 at each end of the bench are interconnected by a stabilizing brace 106. A laterally extending floor frame 110 is provided at the head end 111 of the bench for added bench stability. Floor frame 110 comprises a generally rectangular, substantially closed bent tubular member 112 which surrounds the legs 104 at the head end 111 of the bench. The ends 114 of tubular member 112 are connected to its elongated portion 116 by means of L-shaped braces 118. Legs 104 are bolted to the vertical flanges of braces 118.

The bench also includes a fixed seat portion 120 at the foot end 121 of the bench, and an incline seat portion 122 at the head end 111. Each of these seat portions may comprise a vinyl-covered foam cushion which is secured to a plywood base. Other materials may also be used. The plywood base of fixed seat portion 120 is provided with flanged tubular nuts (not shown) secured in predrilled holes. The fixed seat portion is secured to side rails 102 by means of bolts received in these nuts. Fixed seat portion 120 serves to rigidly brace side rails 102 in their respective positions. Incline seat portion 122 is supported on a pair of L-shaped members 124 (see FIG. 11) which are pivoted adjacent to fixed seat portion 122 to a pivot rod 126 which extends between the side rails 102.

Figure 3:
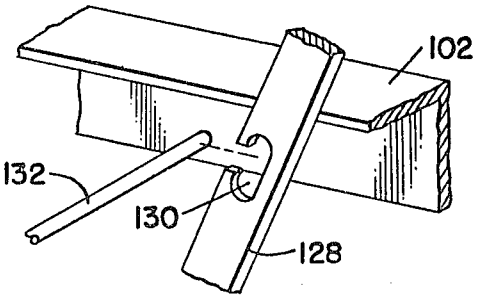
FIG. 3 is a detail view of the adjustable seat supporting mechanism.
Figure 2:
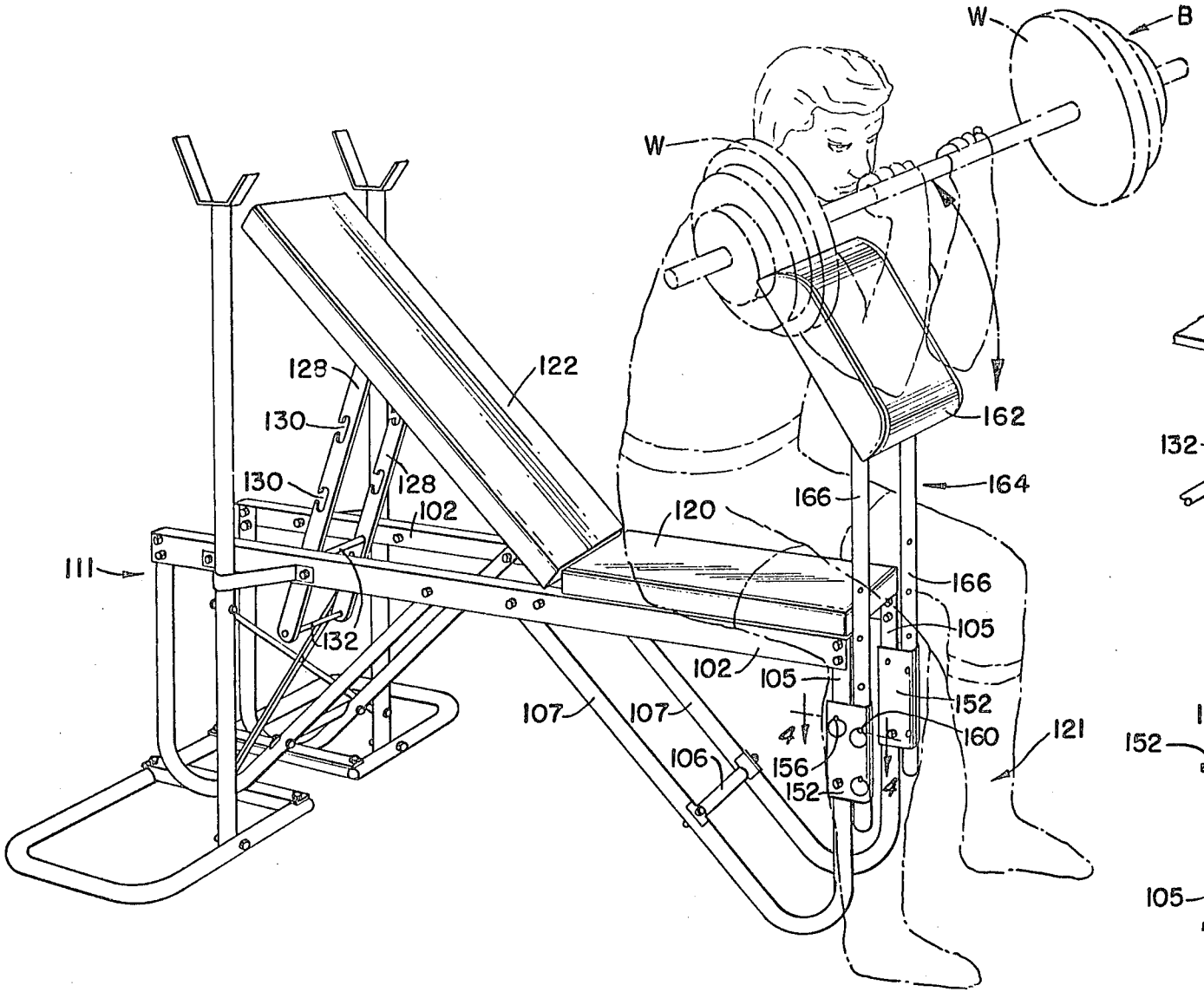
FIG. 2 is a perspective view of the same showing the seat in an inclined position and the use of the barbell curling attachment.
Figure 11:
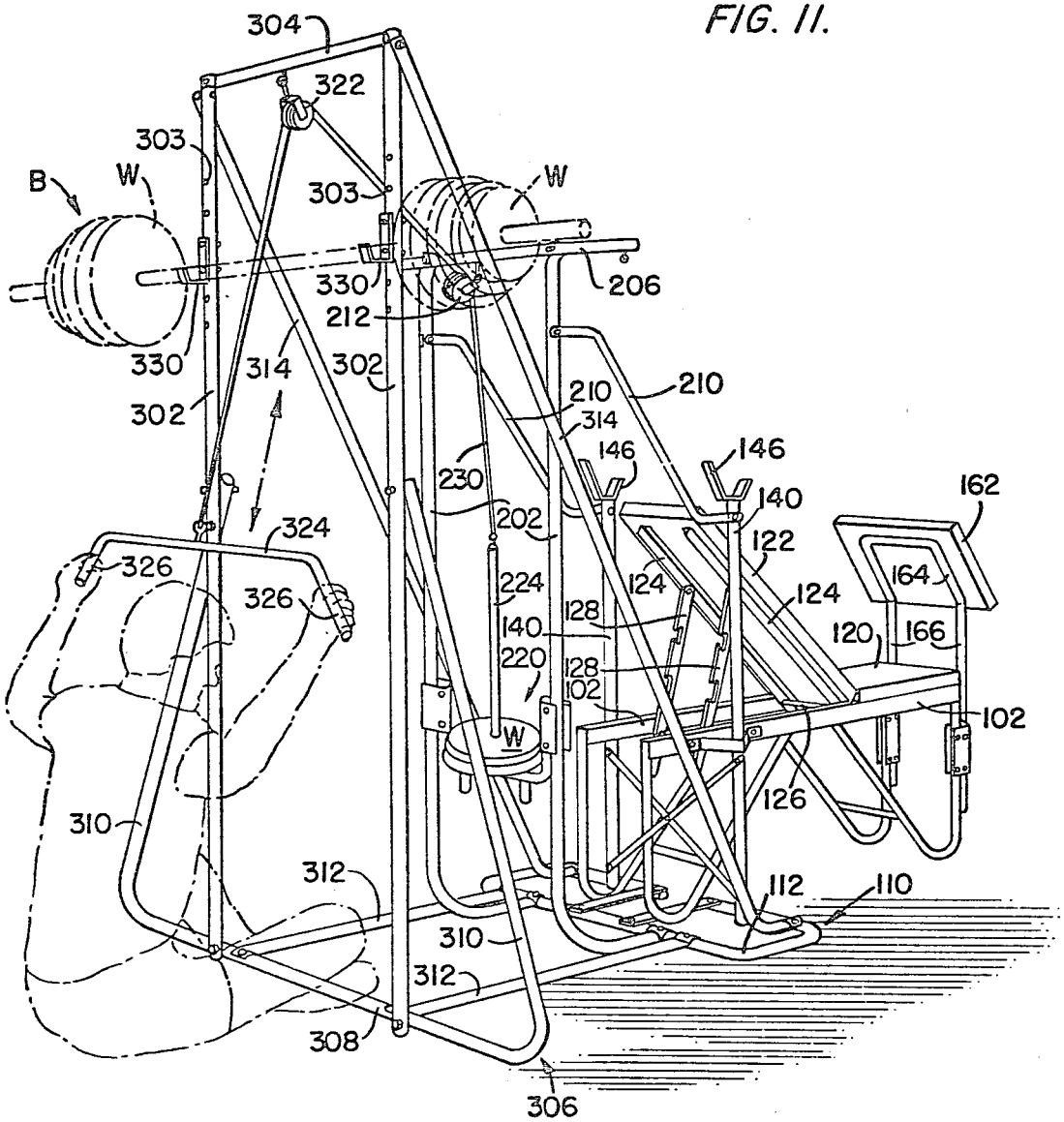
FIG. 11 is a perspective view of the apparatus including the basic bench, weight pull device and lat bar device.

Referring to FIGS. 2, 3 and 11, incline seat portion 122 is adjustably supported on side rails 102 by means of notched struts 128 which are pivotally attached to members 124. Struts 128 have C-shaped notches 130 which are adapted to lock onto a rod 132 secured in side rails 102. This arrangement permits incline seat portion 122 to be positioned at discrete angles of inclination between 0 and approximately 45°.

Bench 100 is also provided with a barbell rest assembly for holding a barbell B having weights W above the bench for use in bench pressing type exercises. The barbell rest assembly comprises a pair of barbell support tubes 140 bolted to tubular floor member 112 and to side rails 102 by means of V-shaped spacer brackets 142. Additional stability is provided by an X-brace 144 which interconnects tubes 140 beneath the bench. A barbell cradle 146 is attached to the top of each tube 140. Support tubes 140 are spaced laterally outwardly from bench side rails 102 to provide a more stable support for the barbell than would be afforded by more closely spaced support tubes, and to provide additional room for the user when lying on the bench. Bench pressing exercises may be performed with the incline seat portion either horizontal or at any desired angle of inclination.

Figure 4:
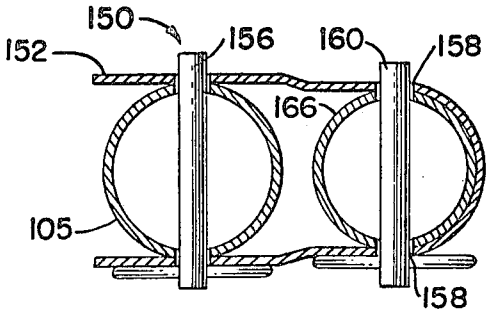
FIG. 4 is a detail sectional view of a portion of the bench taken along line 4—4 in FIG. 2.

Bench 100 may serve as a support for additional exercising devices. To this end, the legs 104 at the foot end 121 of the bench are provided with a pair of socket members 150. Referring to FIG. 4, each socket member 150 comprises a U-shaped channel 152 which flanks the vertical portion 105 of its respective leg and is bolted thereto at 154. The upper portion of channel 152 is secured to leg 104 by means of a ring-attached shear pin 156 received in aligned holes in channel 152 and leg 104. Additional spaced holes 158 are provided in channel 152 and are adapted to be aligned with similarly spaced holes in the frames of other exercising devices inserted into the sockets 150 and secured thereto by means of ring-attached shear pins 160.

One such auxiliary exercising device which may be attached to socket members 150 is illustrated in FIG. 2. This device is an upper arm-supporting barbell curling device which comprises a cushioned board 162 secured to a bent, U-shaped tubular frame 164 (see FIG. 11) having depending, apertured legs 166 which are adjustably secured in socket members 150. With this arrangement, the user may select the proper height for performing the exercise so that he may comfortably sit on fixed seat portion 120 in a substantially erect position.

Another type of auxiliary exercising device which can be used in conjunction with bench 100 is the leg lift device illustrated in FIG. 5. This device comprises a pair of apertured tubular mounting members 170 which are adjustably received in socket members 150. A padded crossbar 172 is bolted across the tips of members 170. Any suitable padding may be used, such as a vinyl-wrapped polyurethane foam. A padded weight bar 174 is pivotally suspended from crossbar 172 by means of two struts 176 having tubular collars 178 at their upper ends. The user may clamp the desired number of weights W to weight bar 174, place the back side of his knee on crossbar 172 and his leg beneath the padded portion of weight bar 174, and proceed to lift his leg against the weights supported on weight bar 174. The height adjustment in socket members 150 permits the user to adjust the leg lift device to a comfortable position.

Figure 7:
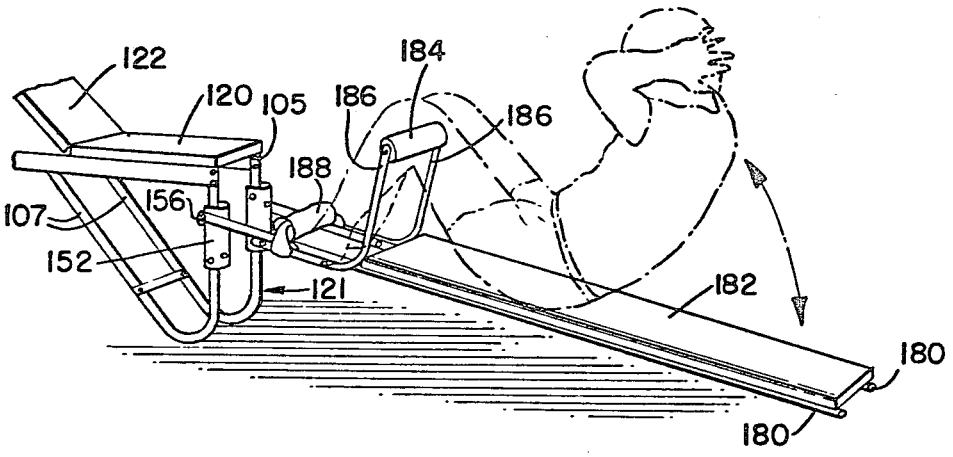
FIG. 7 is a perspective view of the slant board sit-up device attached to the bench.
Figure 8:
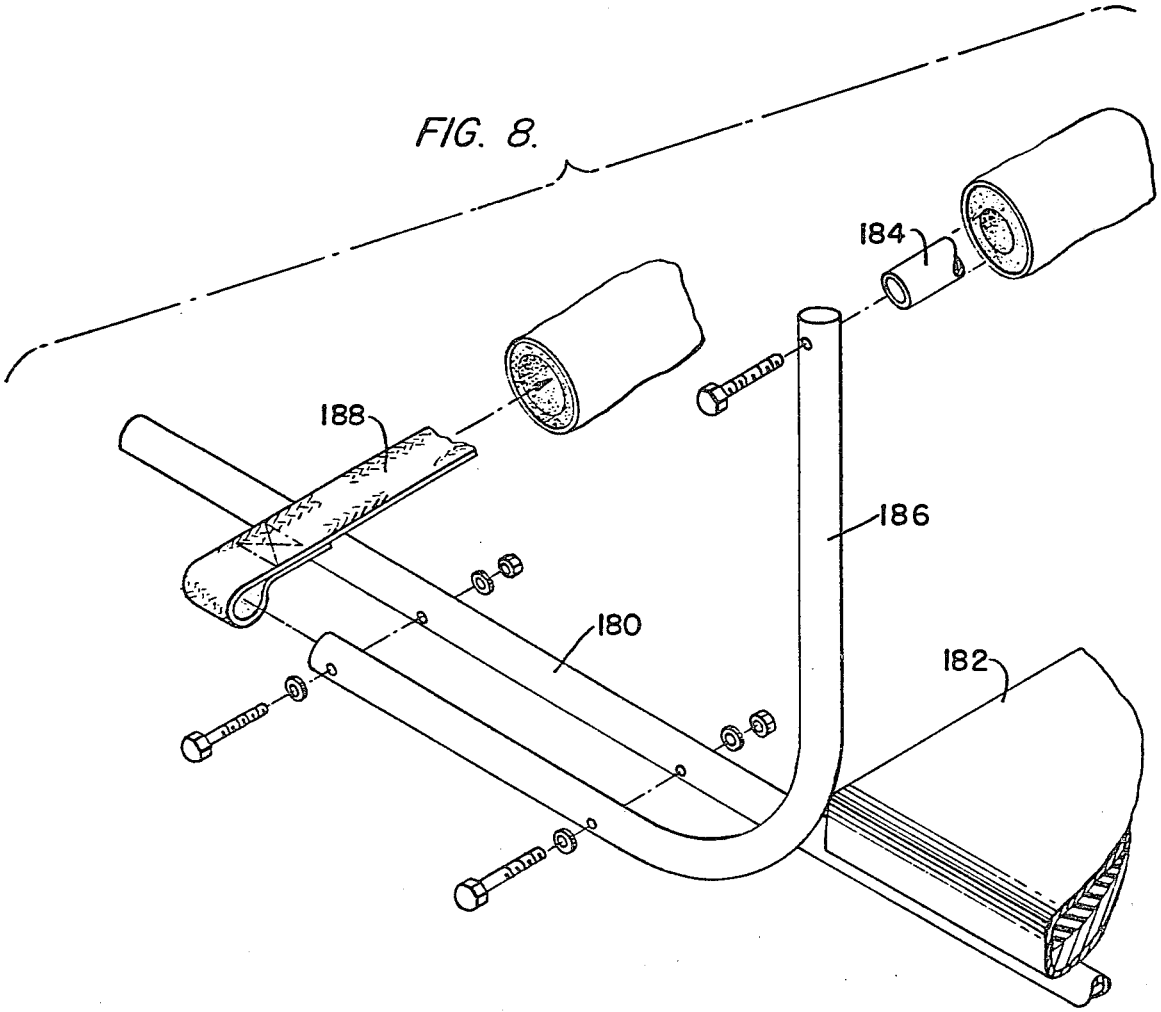
FIG. 8 is an exploded view of a portion of the slant board sit-up device.

Another auxiliary exercising device which may be used in conjunction with bench 100 is the slant board sit-up device illustrated in FIGS. 7 and 8. This device comprises a pair of tubular side rails 180 which support a padded slant board 182. Slant board 182 has a plywood base which carries flanged tubular nuts and is bolted to side rails 180 in the manner of fixed seat portion 120 of bench 100. A raised knee support comprising a padded crossbar 184 is secured to the upper ends of two L-shaped tubular braces 186. Braces 186 are bolted to side rails 180 and support a padded ankle-engaging strap 188. The upper ends of side rails 180 are apertured and are attached to the foot end 121 of bench 100 by means of ring-attached shear pins 156.

The above-described auxiliary exercising devices are of the type which may be quickly and easily attached to the bench as desired. The bench is also adapted to serve as a main support for additional, more permanently secured exercising devices. One such device is the weight pull device 200 illustrated in FIGS. 9 and 10. This device comprises a pair of upstanding parallel tubular guides 202 having curved bottom ends 204 which extend longitudinally of the bench 100 and are attached to tubular member 112 of floor frame 110. The upper ends of guides 202 are interconnected by means of a tubular top crosspiece 206 having laterally projecting and forwardly curved tips 208. The upper portions of guides 202 are rigidly braced against movement by means of oblique braces 210 which are connected to the upper portions of barbell support tubes 140. Top crosspiece 206 supports a pair of central pulleys 212 and a pair of outer pulleys 214 adjacent its ends.

Guides 202 constrain the movement of a liftable weight support 220 (see FIG. 10) which comprises a generally U-shaped tubular cradle 222 having a central upstanding weight rod 224 welded thereto. The legs of cradle 222 are connected to U-shaped channel members 226 which flank guides 202 to prevent lateral movement of the weight support. An eye 228 is provided at the top of weight rod 224 for the attachment of a pair of ropes 230. Each rope 230 is trained over one central pulley 212 and one outer pulley 214 and is connected to a handle 232. Because the tips 208 of crosspiece 206 are curved forwardly, the straight-line paths of the ropes 230 between central pulleys 212 and outer pulleys 214 are unobstructed by guides 202.

In use, the user adjusts the inclination of incline seat portion 122 to form a suitable back support. He then grasps handles 232 and pulls in the desired directions in order to lift the weights W carried by weight support 220. The weight pull device may also be used to perform leg exercises by inserting a foot into one of the handles 232 and leaving the other handle and rope idle. When not in use, handles 232 may be conveniently supported on barbell rest cradles 146.

Figure 9:
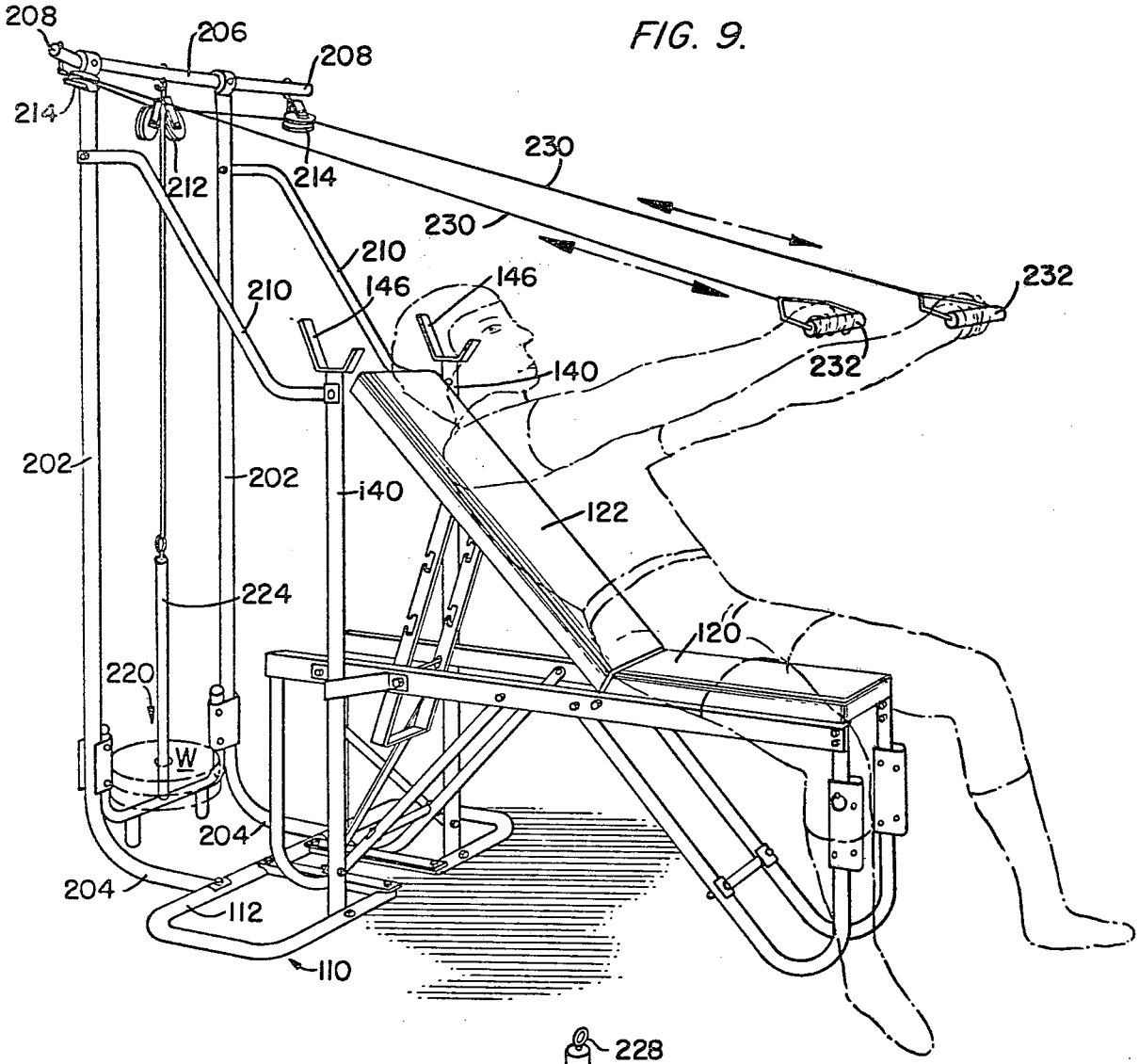
FIG. 9 is a perspective view of the combined bench and weight pull device.
Figure 10:
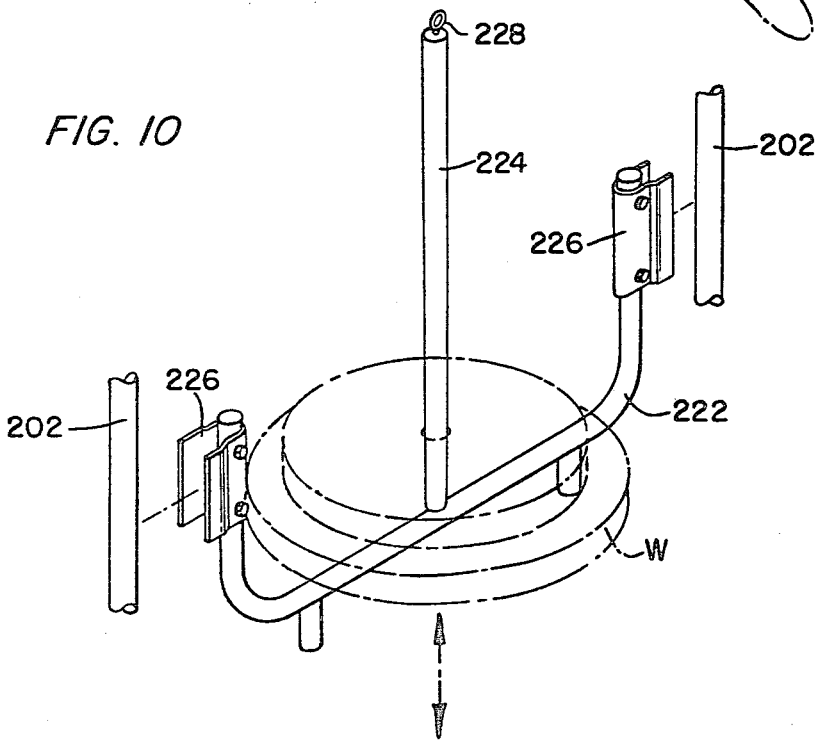
FIG. 10 is a detail perspective view of a portion of the weight pull device.

The weight pull device may also be used to perform standing weight pull exercises from the left end of the assembly illustrated in FIG. 9. In this regard, the ropes 230 would be removed from outer pullegs 214 and be pulled over central pullegs 212 by a user standing to the left of the assembly.

Figure 12:
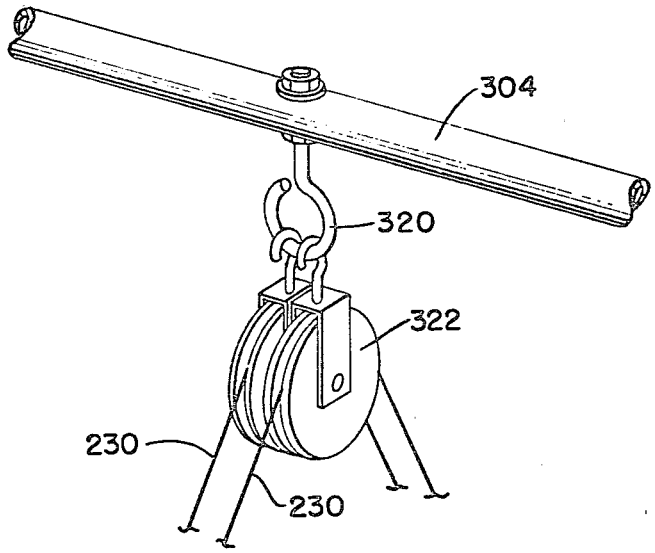
FIG. 12 is a detail view of the lat bar device.

In conjunction with bench 100 and weight pull device 200, a lat bar exercising device may also be attached to the apparatus. Lat bar device 300 is illustrated in FIGS. 11 and 12. This device comprises a pair of laterally spaced upright posts 302 which are interconnected at their top ends by an overhead bar 304. The bottom ends of posts 302 are interconnected by a tubular stabilizer bar 306 having a generally straight bottom portion 308 which extends laterally outwardly past the posts, and is bent upwardly into inwardly converging legs 310 which are connected to posts 302 intermediate their height. This assembly is connected to tubular member 112 of the bench floor frame 110 by means of floor braces 312. The upper ends of posts 302 are secured to member 112 of floor frame 110 by means of oblique tubular struts 314.

Overhead bar 304 supports an eye 320 and a double pulley 322. In converting from the weight pull mode to the lat bar mode, ropes 302 are removed from the outer pulleys 214 of weight pull device 200 and are trained over double pulley 322 and connected to the center of a lat bar 324. Lat bar 324 has hand grip portions 326 at its ends and is grasped and pulled by the user in a seated or other position to raise weight support 220.

Lat bar device 300 may also function as a squat rack for holding a barbell in an elevated position. In this regard, posts 302 are provided with barbell cradles 330 which are bolted to posts 302 through aligned holes 303. Several sets of vertically spaced aligned holes 303 are provided for adjustment of the height of cradles 330. Squatting exercises may then be performed by removing the barbell from cradles 330 and holding it behind the head and across the shoulders. Overhead bar 304 can also be used as a chinning bar.

It can be seen that the exercising apparatus of the invention successfully accomplishes its objectives by virtue of its simplicity, rigidity and versatility. It is capable of many varied uses for exercising substantially all portions of the body. It is estimated that at least 150 different exercises can be performed using this exercising apparatus. From the standpoint of affordability, the user with limited funds may begin by purchasing the basic bench and a barbell set with weights. The weight lift device may be added separately, as may the curling device, the leg lift device and the slant board sit-up device. The lat bar device may be added separately after the weight lift device has been attached.

It will be obvious to one of ordinary skill that numerous modifications may be made without departing from the true spirit and scope of the invention which is to be limited only by the appended claims.

I claim:

1. An exercising apparatus comprising:

(a) a bench having:
  (1) an elongated bench frame;
  (2) a fixed seat portion supported on said bench frame at the foot end of said bench;
  (3) an adjustable incline seat portion hinged to said bench frame adjacent to said fixed portion and extending to the head end of said bench; and
  (4) means for adjustably supporting said incline portion on said bench frame at a desired angle of inclination;

(b) a weight pull device at the head end of said bench having;
  (1) a pair of upstanding spaced apart parallel guides attached to said bench frame;
  (2) a top crosspiece interconnecting the upper ends of said guides;
  (3) weight-supporting means for supporting weights during a raising and lowering operation by a user, said weight-supporting means being slidably guided along said guides;
  (4) weight pulley means guiding a tension element reeved thereover which connects to the weight-supporting means, said weight-supporting means being connected to said top crosspiece; and
  (5) at least one tension element connected to said weight-supporting means and trained through said pulley means to be pulled by a user lying or sitting on said bench; and (c) a lat bar device being positioned forwardly of the head end of the bench and having:
  (1) an upstanding lat frame adjacent the weight pull device, said lat bar device having an overhead bar, said lat frame being connected directly to said bench frame,
  (2) lat pulley means for raising the weight-supporting means, said lat pulley means being connected to said overhead bar, and
  (3) a user-engaged lat bar connected to said weight-supporting means by said tension element which is trained over said weight pulley means and said lat pulley means.

2. An exercising apparatus according to claim 1 wherein said weight pulley means comprises a pair of central weight pulleys mounted centrally of said top crosspiece above said weight rod, and an outer pulley mounted near each end of said top crosspiece, said lat pulley means comprising a pair of lat pulleys mounted centrally of said overhead bar, said at least one tension element comprising a pair of ropes connected to said weight-supporting means, each normally trained over one of said central weight pulleys and one of said outer pulleys but rerouted to said lat bar from said central weight pulleys directly over said lat pulleys.

3. An exercising apparatus according to claim 1 wherein said bench frame includes a laterally extending stabilizing frame and said lat frame comprises a pair of laterally spaced, parallel upright posts joined together at their tops by said overhead bar, a stabilizer bar having a generally straight bottom portion interconnecting the bottoms of said posts and extending laterally outwardly of said posts, and upwardly and inwardly converging legs each joined to one of said posts intermediate its height, a pair of longitudinally extending floor braces interconnecting the bottom portion of said stabilizer bar and said stabilizing frame, and a pair of oblique struts interconnecting the tops of said posts and said stabilizing frame.

4. An exercising apparatus according to claim 3 further comprising a barbell cradle carried by each of said posts.

* * * * *